US009458588B2

(12) United States Patent
Waters, Jr.

(10) Patent No.: US 9,458,588 B2
(45) Date of Patent: Oct. 4, 2016

(54) FLOOD GUARD BARRIER LIFTING SYSTEM

(71) Applicant: Floodbreak, LLC., Houston, TX (US)

(72) Inventor: Louis A. Waters, Jr., Bellaire, TX (US)

(73) Assignee: Floodbreak, LLC, Houston, TX (US)

( * ) Notice: Subject to any disclaimer, the term of this patent is extended or adjusted under 35 U.S.C. 154(b) by 0 days.

(21) Appl. No.: 14/773,124

(22) PCT Filed: Mar. 15, 2014

(86) PCT No.: PCT/US2014/030057
§ 371 (c)(1),
(2) Date: Sep. 4, 2015

(87) PCT Pub. No.: WO2014/145318
PCT Pub. Date: Sep. 18, 2014

(65) Prior Publication Data

US 2016/0010298 A1 Jan. 14, 2016
US 2016/0244928 A2 Aug. 25, 2016

Related U.S. Application Data

(60) Provisional application No. 61/786,785, filed on Mar. 15, 2013.

(51) Int. Cl.
*E02B 7/44* (2006.01)
*E02B 7/50* (2006.01)
(Continued)

(52) U.S. Cl.
CPC ..... *E02B 3/104* (2013.01); *E02B 3/102* (2013.01); *E02B 7/205* (2013.01); *E02B 7/44* (2013.01); *E02B 7/50* (2013.01); *E02B 8/06* (2013.01)

(58) Field of Classification Search
CPC ..... E02B 3/102; E02B 3/104; E02B 7/40; E02B 7/42; E02B 7/44; E02B 7/50
USPC ..... 405/99, 100, 102
See application file for complete search history.

(56) References Cited

U.S. PATENT DOCUMENTS 2,701,953 A * 2/1955 Travilla ..... E02B 7/46 405/102
3,775,983 A * 12/1973 Aubert ..... E02B 7/44 405/102

(Continued)

FOREIGN PATENT DOCUMENTS

DE 10162568 A1 7/2003
DE 202005012770 U1 7/2006

(Continued)

OTHER PUBLICATIONS

Search History Application PCT/US2014/59224.

(Continued)

*Primary Examiner* — Frederick L Lagman
(74) *Attorney, Agent, or Firm* — Tim L. Burgess, P.C.

(57) ABSTRACT

A buoyant flood guard barrier panel passively buoyantly rotationally pivotable upward from horizontal about a first horizontal axis overlays a subframe unattached to the panel. A secondary mechanism for raising the panel has one or more lift arms below the panel transverse to the first axis are rotationally mounted on a second horizontal axis parallel to, below and forward of the first axis. One or more powered drivers act on one or more driven member units each attached to a lift arm rearward of and lower than the second axis to pivot the lift arm on the second axis, rotating the arm upwardly under the panel to rotationally raise the panel. The powered driver may be a winch or a hydraulic actuator.

22 Claims, 9 Drawing Sheets

(51) Int. Cl.

| | |
|---|---|
| ***E02B 3/10*** | (2006.01) |
| ***E02B 7/20*** | (2006.01) |
| ***E02B 8/06*** | (2006.01) |

(56) References Cited

U.S. PATENT DOCUMENTS

| | | | | |
|---|---|---|---|---|
| 4,146,346 | A | 3/1979 | Salo | |
| 4,377,352 | A | 3/1983 | Goodstein | |
| 4,576,509 | A | 3/1986 | Beaty, Sr. | |
| 5,310,284 | A * | 5/1994 | Snowberger | E02B 7/44 405/102 |
| 5,483,913 | A | 1/1996 | Ohkawa | |
| 5,758,989 | A * | 6/1998 | Snowberger | E02B 7/44 405/100 |
| 6,216,399 | B1 | 4/2001 | Belarbi | |
| 6,623,209 | B1 | 9/2003 | Waters, Jr. | |
| 7,033,112 | B2 * | 4/2006 | Rijlaarsdam | E02B 3/102 405/100 |
| 7,435,036 | B2 | 10/2008 | Cullen | |
| 7,658,572 | B2 | 2/2010 | Miyao | |
| 9,279,224 | B2 * | 3/2016 | Waters, Jr. | E02B 3/104 |
| 2009/0185864 | A1 | 7/2009 | Waters, Jr. | |
| 2012/0148346 | A1 | 6/2012 | Eftekharzadeh | |
| 2012/0163916 | A1 | 6/2012 | Waters, Jr. | |
| 2014/0369754 | A1 * | 12/2014 | Waters, Jr. | E02B 3/104 405/16 |

FOREIGN PATENT DOCUMENTS

| | | | | |
|---|---|---|---|---|
| DE | 102011085963 | A1 | 5/2013 | |
| FR | 2926095 | A1 * | 7/2009 | E02B 3/104 |
| GB | 2304770 | A | 3/1997 | |
| GB | 2399375 | A | 9/2004 | |
| GB | 2425559 | A | 11/2006 | |
| GB | WO 2006120410 | A1 * | 11/2006 | E02B 3/104 |
| GB | 2457463 | A | 8/2009 | |
| JP | 10-152827 | | 9/1998 | |
| JP | 2001-214425 | | 7/2001 | |
| JP | 2003-221822 | | 8/2008 | |
| SG | GB 2323621 | A * | 9/1998 | E02B 3/104 |
| WO | 2006/120410 | A1 | 11/2006 | |

OTHER PUBLICATIONS

Search Report and Written Opinion PCT/US2014/59224.

Notification of Transmittal of International Preliminary Report on Patentability, International Preliminary Report on Patentability with Annexes: Amended Sheets 17-23 (amended claims), Amendments Under Rule 34 and Letter Accompanying Amendments Under Rule 34.

Presray. FB55 Bottom Hinged Flood Gate with Inflatable Seal [online] Mar. 24, 2004 [retrieved Aug. 25, 2014 by ISA/US from Internet; ISR mail dated Sep. 22, 2014 by ISA/US.

* cited by examiner

FLOOD GUARD BARRIER LIFTING SYSTEM

CROSS-REFERENCE TO RELATED APPLICATIONS

This application claims under 35 U.S.C. §119(e) the benefit of U.S. Provisional Application 61/786,785 filed on Mar. 15, 2013, the content of which is incorporated in its entirety.

STATEMENT REGARDING FEDERALLY SPONSORED RESEARCH AND DEVELOPMENT

Not Applicable

BACKGROUND OF THE DISCLOSURE

1. Field of Disclosure

This invention relates to barriers for protecting shorelines from floodwaters and to systems for elevating the barriers into position for protective duty.

2. Background

Floodwaters are a major source of property damage. Floodwaters may come from a surface flooding caused heavy rains, or from a rising body of water, such as storm surge of sea waters driven by hurricane or tropical storm or from swollen rivers rising above flood stage from snow melt or heavy rains. Flooding in coastal areas resulting from tropical storms, hurricanes, cyclones or typhoons produces death and destruction. Storm surge is the major cause of flooding. This was all too painfully shown when on Oct. 29, 2012 tropical storm Sandy struck New York City, its suburbs, and Long Island. Supplemented by a high tide, the storm surge was approximately 14 feet above mean low tide, overtopping seawalls and bulkheads lining Manhattan and other waterfront boroughs, flooding many tunnels, damaging electrical equipment, costing at least 48 lives and in effect shutting down the City. Damages and economic losses across New York were estimated to be at least $33 billion and in neighboring New Jersey, $36.8 billion.

The inventor of embodiments of the invention described herein has disclosed in U.S. Pat. No. 6,623,209 a flood guard barrier employing water buoyant rigid flood barrier panels that are self-actuating. Although this barrier is self actuating, if there is sufficient warning of a flooding event, a system for raising a flood guard panel in advance of the arrival of the flooding event is an additional benefit. In addition a system for raising the flood guard panel independently of a flooding event allows the flood guard panel to be conveniently raised for servicing and repairs.

BRIEF DESCRIPTION OF THE DRAWINGS

In the following detailed description of exemplary embodiments, reference is made to the accompanying drawings, which form a part hereof and in which are shown by way of illustration examples of exemplary embodiments with which the invention may be practiced. In the drawings and descriptions, like or corresponding parts are marked throughout the specification and drawings with the same reference numerals. The drawings are not necessarily to scale. Certain features of the invention may be shown exaggerated in scale or in somewhat symbolic or schematic form and some details of conventional elements may not be shown in the interest of clarity and conciseness. Referring to the drawings:

FIG. 1 is a top plan view of an exemplary embodiment of a flood guard barrier comprising a self actuating buoyant panel resident in a housing and employing a winch system in accordance with this invention for raising the panel independently of a flooding event. Dotted lines represent structure under the top of the panel.

FIG. 2 is a top plan view of the embodiment of FIG. 1 with the panel removed, showing the housing or pan in which the panel resides.

FIG. 3 is a sectional end view of the embodiment in FIG. 2.

FIG. 4 is a top plan view of an exemplary embodiment of a lift arm package comprising part of a winch system in accordance with this invention.

FIG. 5 is a side elevation view of the lift arm of FIG. 4 taken along the line 5-5 of FIG. 4.

FIG. 6 is a sectional view of the embodiment of FIG. 1 along the line 6-6 of FIG. 1 showing the lift arm and the buoyant panel resident in the housing.

FIG. 7 is a sectional view of the embodiment of FIG. 1 along the same line of view as FIG. 6 showing the lift arm and the buoyant panel erect out of the housing.

FIG. 8 is a top plan view of an embodiment in which a driver powered to effect lift comprises a hydraulic actuator driving a driven member acting on a lift arm. In the plan view the barrier comprising a plurality of panels raised to expose the driver and driven member.

FIG. 9 is a perspective view of the embodiment depicted in FIG. 8.

FIG. 10 is an enlargement of a portion of the view of FIG. 9 showing portions of the embodiment in greater detail.

FIG. 11 is a side view of the embodiment seen in perspective in FIGS. 9 and 10.

FIG. 11B is an enlargement of a portion of FIG. 11 indicated by dashed lines pointed to by reference numeral 11B.

DETAILED DESCRIPTION OF EMBODIMENTS

Figure 1:
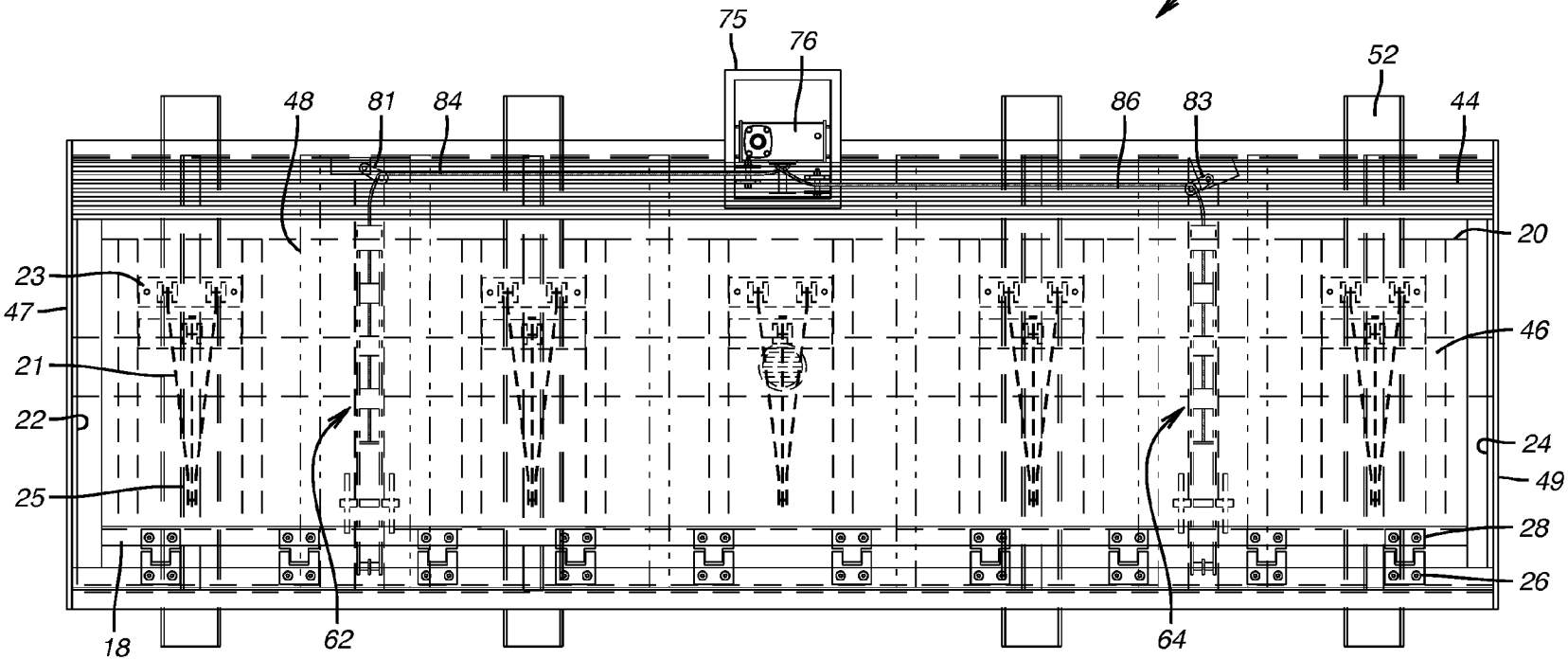
FIGS. 1-7 show an exemplary embodiment of a flood guard barrier lift system in accordance with this invention in which a driver powered to effect lift of a barrier panel comprises a winch winding a cable as a driven member acting on a lift arm.

Specific details described herein, including what is stated in the Abstract, are in every case a non-limiting description and exemplification of embodiments representing concrete ways in which the concepts of the invention may be practiced. This serves to teach one skilled in the art to employ the present invention in virtually any appropriately detailed system, structure or manner consistent with those concepts. Any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments that may or may not be given therewith or elsewhere in the specification and all such embodiments are intended to be included within the scope of that term or terms. Language designating such nonlimiting examples and illustrations includes, but is not limited to: "for example," "for instance," "e.g.," "in an embodiment," "in an exemplary embodiment."

Reference throughout this specification to "an embodiment" means that a particular feature, structure, or characteristic described in connection with the embodiment is included in at least one exemplary embodiment of the present invention. Thus, the appearances of the phrase "in an exemplary embodiment" in various places throughout this specification are not necessarily all referring to the same embodiment. Furthermore, the particular features, structures, or characteristics may be combined in any suitable manner in one or more embodiments. It will be seen that various changes and alternatives to the specific described embodiments and the details of those embodiments may be made within the scope of the invention. It will be appreciated that one or more of the elements depicted in the drawings can also be implemented in a more separated or integrated manner, or even removed or rendered as inoperable in certain cases, as is useful in accordance with a particular application. Because many varying and different embodiments may be made within the scope of the inventive concepts herein described and in the exemplary embodiments herein detailed, it is to be understood that the details herein are to be interpreted as illustrative and not as limiting the invention to that which is illustrated and described herein.

As used herein, the terms "comprises," "comprising," "includes," "including," "has," "having" or any other variation thereof, are intended to cover a non-exclusive inclusion. For example, apparatus that comprises a list of elements is not necessarily limited to only those elements but may include other elements not expressly listed or inherent to such process, article, or apparatus. Further, unless expressly stated to the contrary, "or" refers to an inclusive or and not to an exclusive or. That is, unless otherwise indicated, the term "or" is generally intended to mean "and/or". For example, a condition A or B is satisfied by any one of the following: A is true (or present) and B is false (or not present), A is false (or not present) and B is true (or present), and both A and B are true (or present).

As used herein, a term preceded by "a" or "an" (and "the" when antecedent basis is "a" or "an") includes both singular and plural of such term (unless in context the reference "a" or "an" clearly indicates only the singular or only the plural). Thus the use of the word "a" or "an" may mean "one," but it is also consistent with the meaning of "at least one" and "one or more than one."

As used in the description herein, the meaning of "in" includes "in" and "on" unless the context clearly dictates otherwise.

In addition, as used herein, the phrase "connected" means joined to or placed into communication with, either directly or through intermediate components.

The various directions such as "upper," "top", "lower," "bottom", "back," "front," "transverse," "vertical", "horizontal," "length," "Longitudinal," "width," "laterally," "forward," "rearward" and so forth used in the detailed description of exemplary embodiments are made only for easier explanation in conjunction with the drawings. The components may be oriented differently while performing the same function and accomplishing the same result as the exemplary embodiments herein detailed embody the concepts of the invention, and such terminologies are not to be understood as limiting the concepts which the embodiments exemplify.

In accordance with this invention, a flood guard barrier comprising at least one buoyant panel having front, back and lateral ends, a longitudinal dimension between the lateral ends, substantially horizontally disposed relative to earth, is passively responsive to a rise of water higher than the substantially horizontally disposed panel to buoyantly rotationally pivot upwardly to a raised position. Pivotation is provided by pivotation members comprising a stationary member connected to a support and a moveable member moveably joined to the stationary member, the moveable member being connected to the back end of the panel and pivotable about a horizontally longitudinal first axis of rotation. The barrier includes a subframe unattached to the panel and positioned under the panel so as not to interfere with passive rise of the panel. The subframe supports a secondary mechanism for elevating the panel in the absence of water causing passive rise.

The secondary mechanism comprises at least one lift arm positioned under the panel transversely to the first axis of rotation. The lift arm is supported on the subframe for pivotation from a horizontal disposition rotationally upward about a horizontal second axis of rotation that is parallel to and lower than the first axis of rotation. The lift has an aft portion rearward of the second axis and a fore portion forward of the second axis. At least one powered driver is fixed on a support optionally either rearward of the second axis or distally forward of the second axis, and a driven member unit comprising at least one driven member is connected proximately to the powered driver and distally to the aft portion of a lift arm at a connecting distance rearward of the second axis, whereby on activation of the driver the aft portion is rotated forward and the fore portion is rotated upward on the second axis under the panel to lift the panel rotationally upwardly on the first axis to a raised position. In an embodiment, the second axis of rotation is forward of the first axis of rotation. In an embodiment, the position rearward of the second axis to which the driven member is connected is a radial distance measured from the second axis sufficient that on actuation of the driver the driven member at the position of connection need not travel more than twice such radial distance to effect rotation of the lift arm through 90 degrees.

In one embodiment, the aforementioned powered driver comprises a hydraulic actuator and the driven member comprises a rod connected to a piston moveable in a cylinder in said hydraulic actuator. In another embodiment, the aforementioned powered driver comprises at least one winch having a drum rotatable on a third axis of rotation and the driven member comprises a cable proximally connected to and windable on the drum. In both such embodiments the driven member unit is connected distally to the aft portion of a lift arm at a connecting distance rearward of the second axis.

In the embodiment in which the powered driver comprises the hydraulic actuator, the actuator comprises a barrel or cylinder with a bore of constant diameter along the cylinder length. The cylinder is closed on each end, at a cap end and a head end. A piston travels back and forth in the cylinder and divides the inside of the cylinder in two chambers. A rod is connected to one side of the piston. The rod extends through the head end. The actuator may be a single acting actuator with fluid supplied to the head end to cause an extended rod to retract into the cylinder, the rod extending when fluid pressure is removed from the head end; or vice versa, fluid pressure may be supplied to the cap end to extend the rod from the cylinder, the rod retracting into the cylinder when the fluid pressure is removed. Alternatively, the actuator may be a double acting actuator in which fluid is supplied to the cap end to extend the rod and to the head end to retract the rod.

In the embodiment in which the powered driver comprises a hydraulic actuator, the actuator may be rearward of the aforementioned second axis or distally forward of the second axis.

In an embodiment in which the actuator is rearward of the second axis, the driven member unit comprising the actuator rod is connected to the aft portion of said lift arm in such a manner that, on actuation of the actuator, extension of the actuator rod pushes and rotates the aft portion of the lift arm forward and the fore portion upward about the second axis, thus lifting the flood barrier panel rotationally upwardly about the first axis to a raised flood guarding position.

In an embodiment in which the actuator is distally forward of the second axis, a reversing drive linkage interconnects the actuator rod and the drive shaft that is moveably joined distally to the aft portion of said lift arm. The linkage comprises a moveable link pivoted on a shaft, for example the link may be horizontally movable on a vertical shaft. The link is moveable connected proximally to the distal end of the actuator rod and distally to the proximal end of the drive shaft. Extension of the actuator rod drives the proximate end of the pivotation link in the same direction as the rod, pivoting the link on the shaft, which swings the distal end of the link in direction opposite the direction in which the rod is extending, thus reversing the direction of force produced by the actuator rod. Since the distal end of the link is connected to the proximal end of the drive shaft, this pulls the drive shaft in a direction parallel and opposite the direction of extension of the actuator rod. Pulling the drive shaft rotates the connected aft portion of the lift arm forward on the second axis and rotates the fore portion of the lift arm upwardly, lifting the flood barrier panel rotationally upwardly about the first axis to a raised flood guarding position In the embodiment in which the powered driver comprises at least one winch having a drum rotatable on a third axis of rotation and the driven member comprises a cable proximally connected to and windable on the drum, the third axis may be either parallel or transverse to the first axis of rotation.

In an embodiment in which the third axis on which the drum is rotatable is parallel to the first axis, the third axis may be either distally forward of the second axis or rearward of the second axis.

In an embodiment in which the third axis is parallel to the first axis and distally forward of the second axis, rotation of the drum on such third axis winds the cable toward the drum, rotating the aft portion of the lift arm forward and the fore portion upward about the second axis, lifting the flood barrier panel rotationally upwardly about the first axis to a raised flood guarding position.

In an embodiment in which the third axis is parallel to the first axis and rearward of the second axis, at least one cable pulley is provided horizontally distally forward of the second axis of rotation to reverse the direction of travel of a cable sheaved through the pulley routing the cable for connection to the aft portion of a lift arm at a connecting distance rearward of the second axis. Rotation of the drum on such third axis winds the cable toward the drum, the pullet reversing the direction of draw to pull the aft portion of the lift arm rotationally forward and the fore portion rotationally upward about the second axis, thus lifting the flood barrier panel rotationally upwardly about the first axis to a raised flood guarding position.

In an embodiment in which the third axis on which the drum is rotatable is transverse to the first axis of rotation, the third axis is distally forward of the second axis, and the embodiment further comprises at least one cable pulley distally forward of the second axis and horizontally spaced from the drum.

An embodiment in which a winch drum is rotatable on a third axis that is transverse to the first axis of rotation and that is distally forward of the second axis further comprises a pair of lift arms, a single winch, a pair of the pulleys each distally spaced from the drum, and a pair of the cables, each sheaved across a the pulley and distally connected to an aft portion of the lift arm. In an embodiment having these elements, a support for the stationary pivotation member may be a topless housing having a floor, a back and a front, sized for receiving and housing the panel horizontally above the floor, the stationary pivotation member being connected to the back of such housing, and the floor may comprise a pair of longitudinally spaced slots transverse to the first axis of rotation. A pair of longitudinally spaced upwardly open channel members each parallel to the slots may be connected under the slots to the housing floor. The lift arms may reside horizontally disposed in the channel members under the panel when not lifted.

In an embodiment in which the powered driver comprises a winch and the driven member comprises a cable, the cable connecting to the aft portion of the lift arm may distally run to the aft portion at a height lower than the lift arm top (the lift arm having a top and bottom). In an embodiment, the lift arm may be vertically deepest top to bottom at an aft location. In an embodiment, the lift arm may taper bottom toward top from the aft portion to the fore portion. In an embodiment, the aft portion where the cable is connected to the lift arm may be rearward of the location where the arm is vertically deepest and may be proximate the top of the lift arm.

In an embodiment the lift arm may comprise a pair of horizontally spaced vertical plates joined in a fore portion by at least one horizontal joining member and in an aft position proximate their tops by a horizontal pin, the cable attaching to the pin. In an embodiment, the pin may be lower than the second axis of rotation.

In an exemplary embodiment in which the powered driver is a winch, a flood guard barrier comprises: a buoyant panel having front, back and lateral ends, a longitudinal dimension between the lateral ends, and is substantially horizontally disposed relative to earth; a topless housing having a floor, a back, a front, and lateral ends, sized for receiving the panel horizontally above the floor; and pivotation members comprising a stationary member connected to the housing back and a moveable member moveably joined to the stationary member, the moveable member being connected to the back of the panel and pivotable about a horizontally longitudinal first axis of rotation, the panel being passively responsive to a rise of water higher than the substantially horizontally disposed panel to buoyantly rotationally pivot upwardly about said first axis to a raised position. The floor of the housing has a pair of longitudinally spaced slots transverse to the first axis of rotation. A pair of longitudinally spaced, upwardly open channel members are parallel to the slots and are connected under the slots to the housing floor. A pair of lift arms is resident in the channel members under the slots.

Each arm is supported from the floor for pivotation about a horizontal second axis of rotation that is parallel to, lower than and forward of the first axis of rotation. The arms have an aft portion rearward of the second axis and a fore portion forward of the second axis. A winch at the front of the housing is intermediate the lateral ends of the housing and comprises a drum rotatable on a third axis of rotation transverse to the first axis of rotation. A pair of cable pulleys has each pulley connected adjacent the front of the housing horizontally distally spaced from the drum. A pair of cables has each cable connected on one end to the drum, each sheaved across a pulley, and each connected at an opposite end to an aft portion of a lift arm at a connecting distance rearward of said second axis. Each cable on activation of the drum draws the aft portion of a connected lift arm rotationally forwardly and pivots the fore portion of the lift arm rotationally upwardly on the second axis and out of the channel member through the slot under the panel, raising the panel rotationally on the first axis upwardly out of the housing.

In an exemplary embodiment in which the powered driver is a hydraulic actuator, a buoyant flood guard barrier comprises a panel having front, back and lateral ends, a longitudinal dimension between the lateral ends and is substantially horizontally disposed relative to earth. A subframe assembly includes front and back members. Pivotation members comprise a stationary member connected to the back frame member and a moveable member moveably joined to the stationary member. The moveable member is connected to the back end of the panel and is pivotable about a horizontally longitudinal first axis of rotation, the panel being passively responsive to a rise of water higher than the horizontally disposed panel to buoyantly rotationally pivot upwardly about said first axis to a raised position. A secondary mechanism for elevating said horizontally disposed panel comprises a plurality of lift arms. Each arm is mounted on an axle supported on the frame assembly for pivotation about a horizontal second axis of rotation that is parallel to, lower than and forward of the first axis of rotation. The arms have an aft portion rearward of the second axis and a fore portion forward of the second axis. A hydraulic actuator is connected to a front member of the frame assembly. The actuator has a rod connected to a piston moveable in a cylinder, a distal end of said rod extendable from a head end of the actuator in a direction transverse to said first axis. A reversing link is proximately pivotingly joined to the distal end of the actuator rod and is pivotal for reversing movement on a pivot shaft. A drive shaft is proximally pivotingly joined to a distal end of the intermediate link and is rotatably connected distally to the aft portion of a lift arm at a radial distance measured from and rearward of the second axis. The rearward radial distance is selected such that on actuation of the actuator the drive shaft linked by the reversing link to the actuator rod need not travel a distance more than twice the radial distance to effect rotation of the lift arm on the second axis through 90 degrees to lift the panel rotationally upwardly on the first axis to a raised position Referring now to the drawings, FIGS. 1 through 7 involve an exemplary embodiment in which the powered driver and driven members of a flood guard barrier is a winch and cable system. Reference numeral 10 indicates an exemplary embodiment of a flood guard barrier and winch system in accordance with this invention in which the barrier employs a buoyant panel and a pair of lift arms. A buoyant panel 12 comprising connected extruded ribbed aluminum panel members has a top 14 and bottom 16, back and front ends 18, 20, lateral ends 22, 24, a height from the back 18 to front 20, and a longitudinal dimension between the lateral ends 22, 24 transverse to the height. Pivotation members comprise a stationary member 26 connected to pan 32 and a moveable member 28 moveably joined to stationary member 26, the moveable member 28 being connected to the back end 18 of panel 12 and pivotable about a horizontally longitudinal first axis of rotation 30 for pivotation of panel 12 rotationally upwardly about axis 30.

Figure 2:
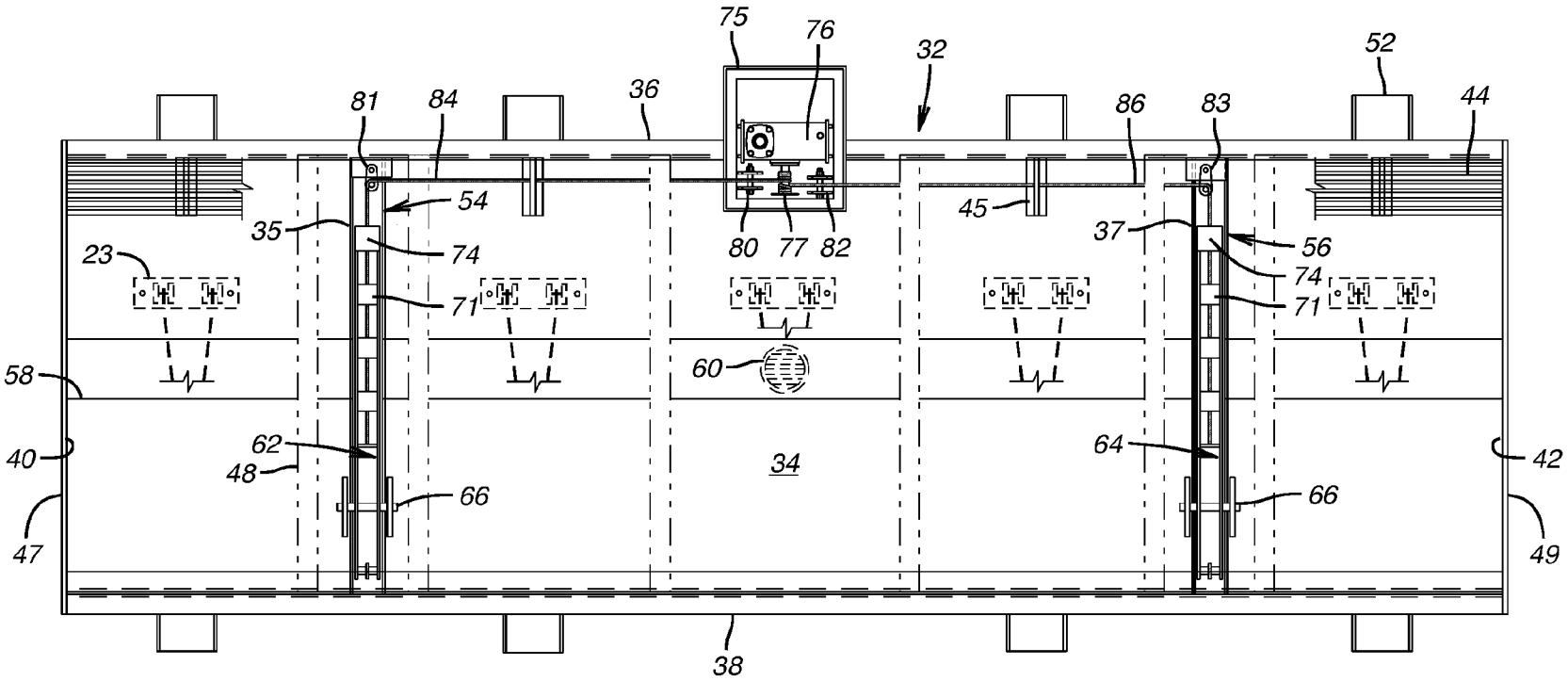
Figure 3:
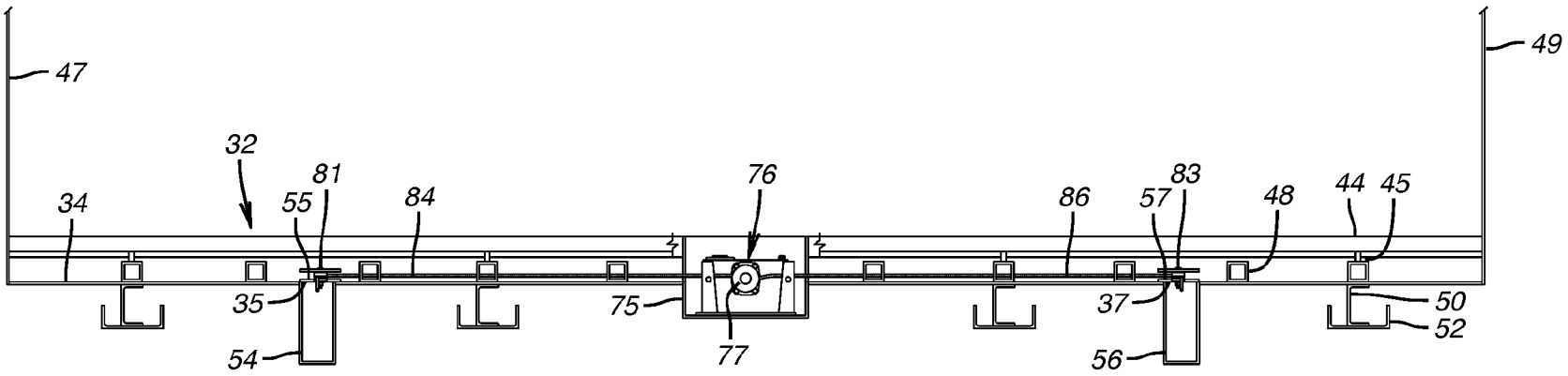
Figure 6:
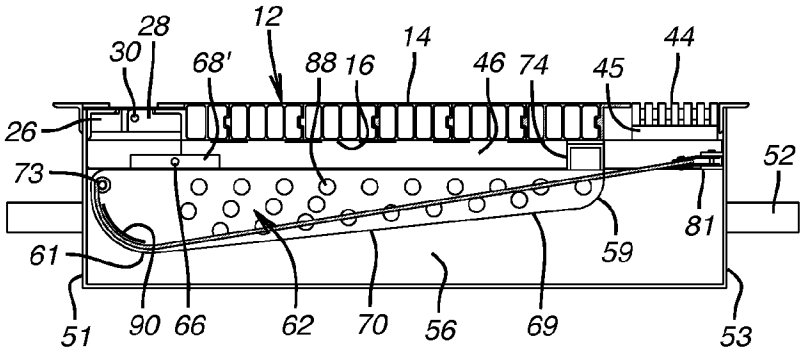
Figure 7:
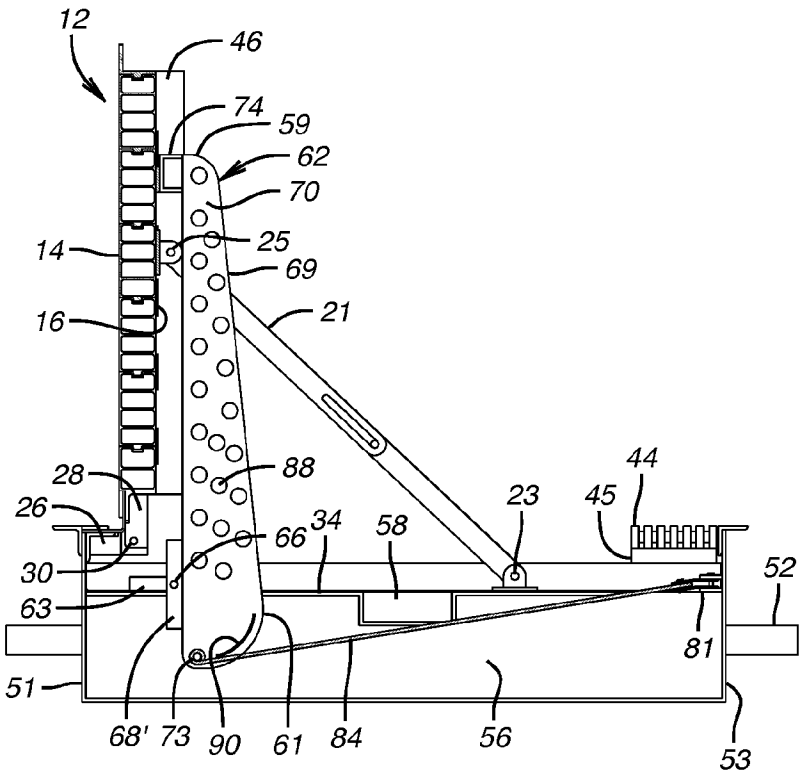
Figure 8:
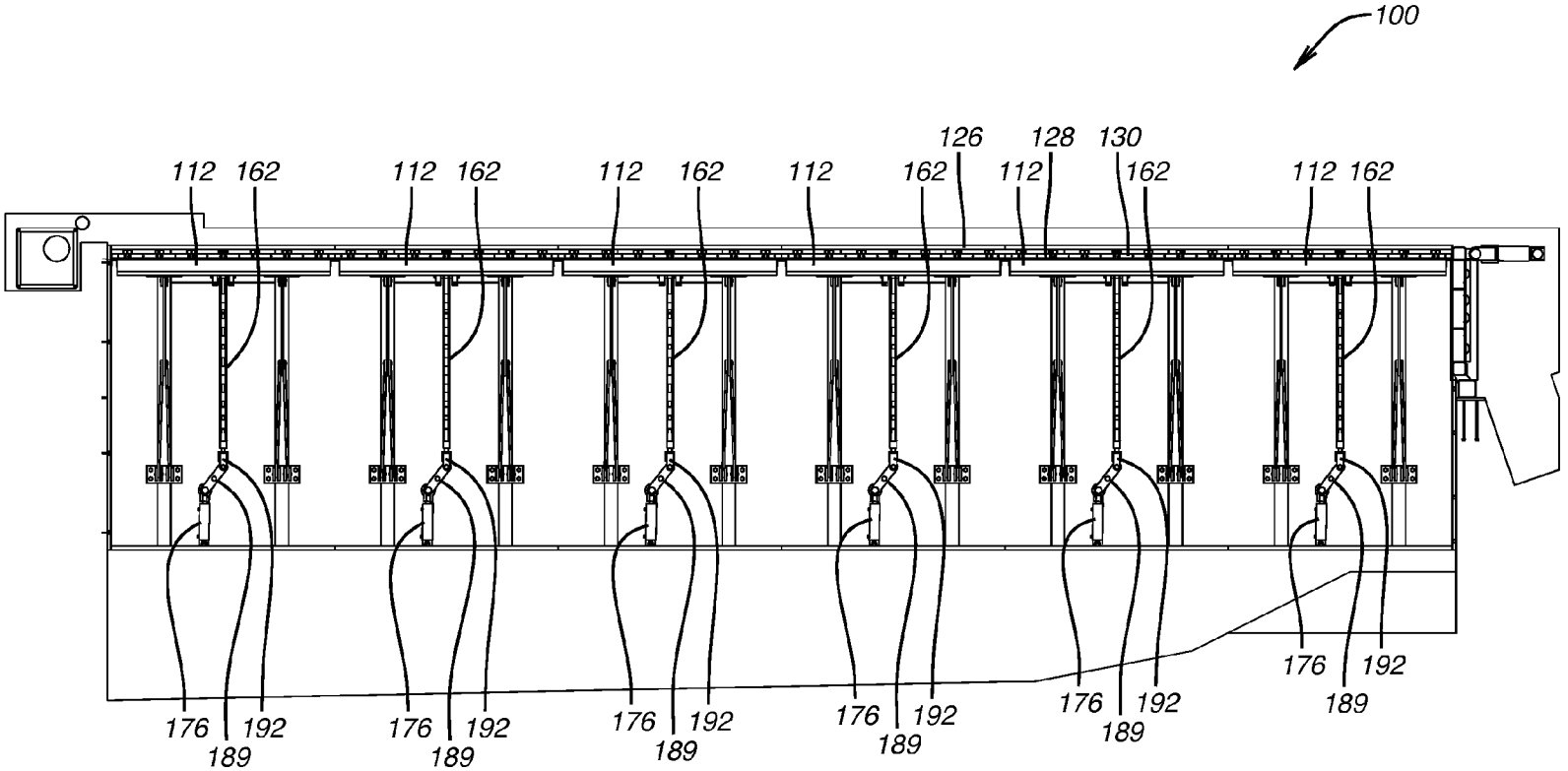
FIGS. 8-11B show another exemplary embodiment of a flood guard barrier lift system in accordance with this invention in which a driver powered to effect lift comprises a hydraulic actuator driving a driven member acting on a lift arm.
Figure 9:
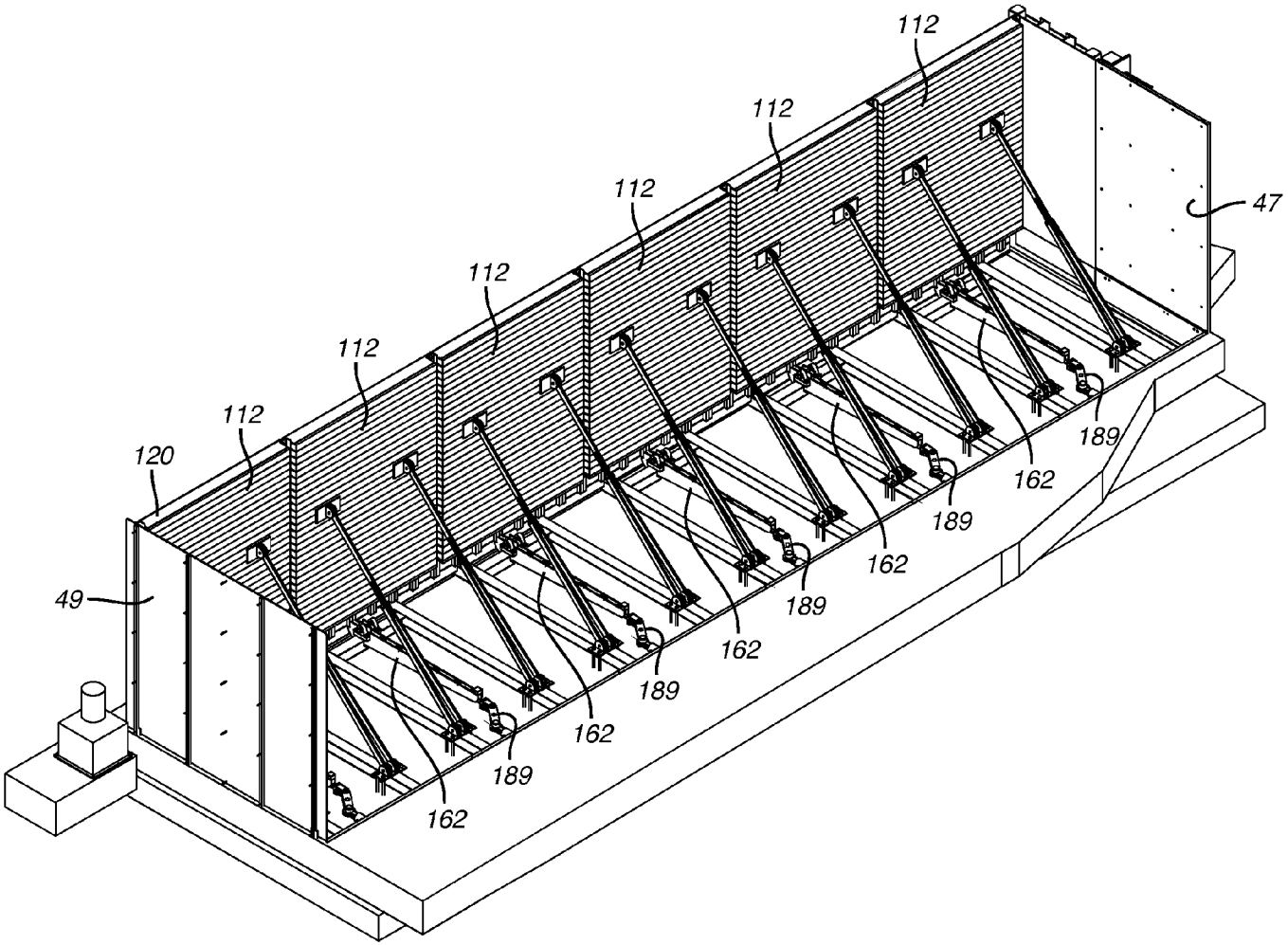
Figure 10:
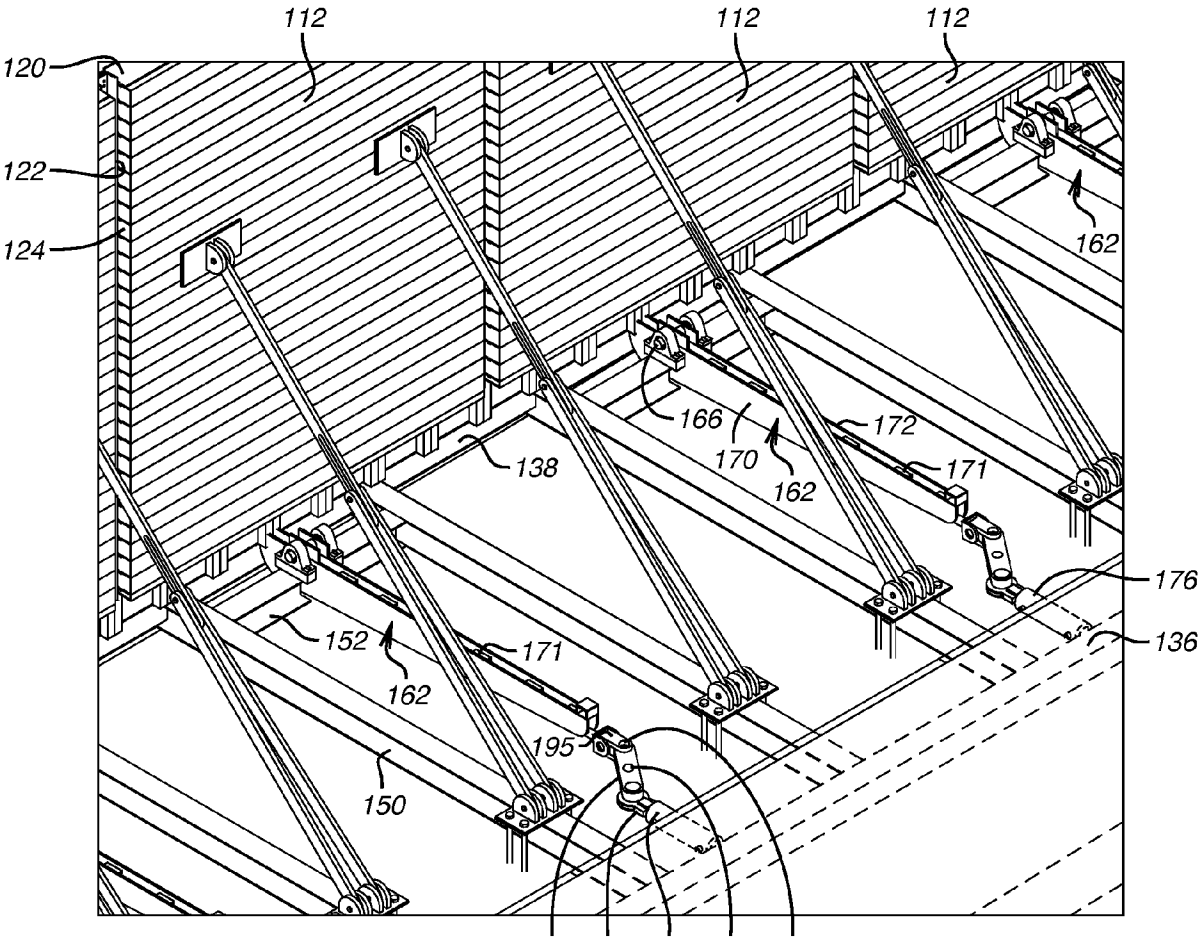
Figure 11:
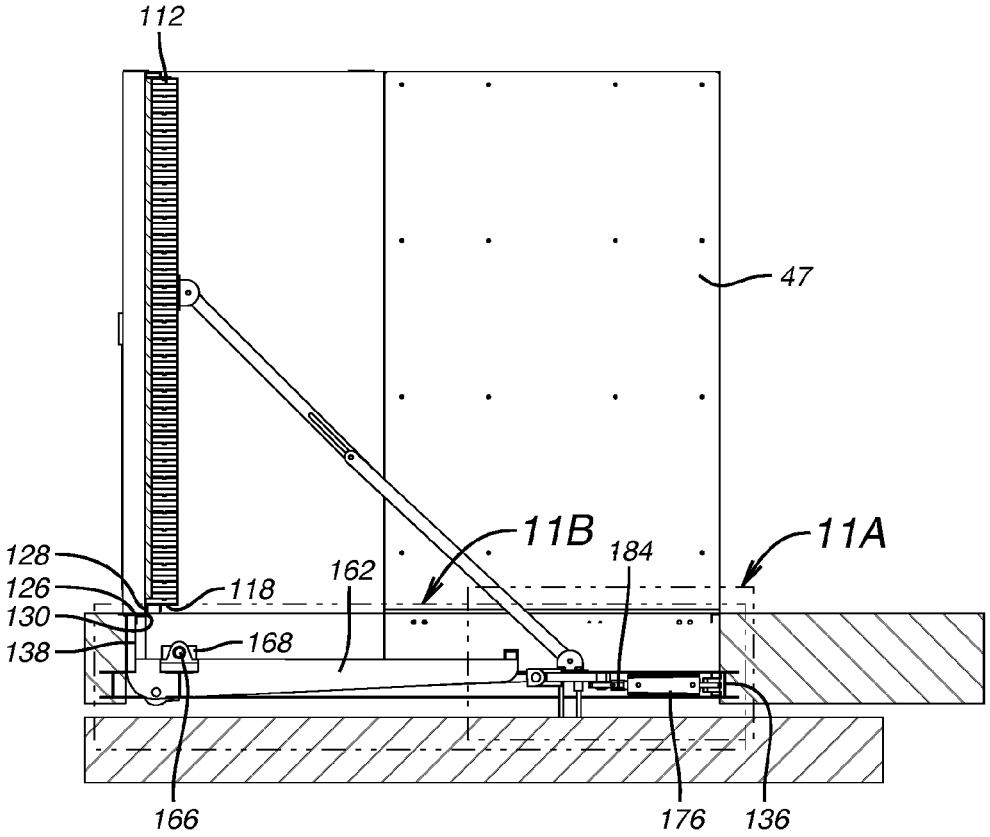
Figure 11A:
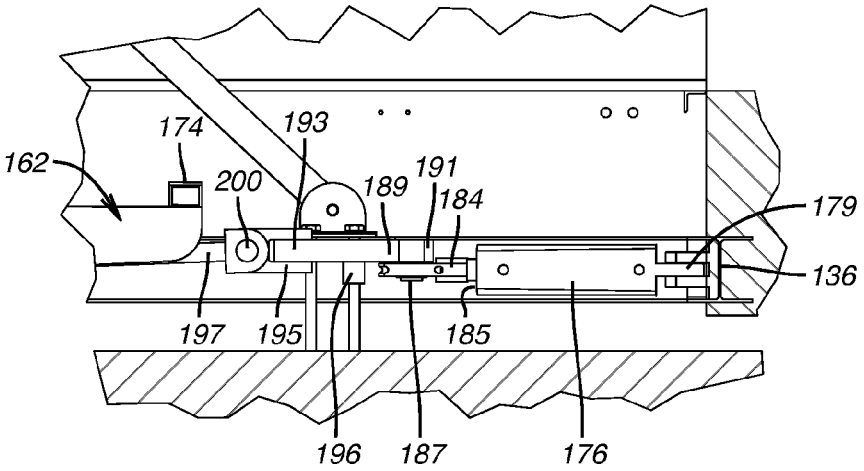
FIG. 11A is an enlargement of a portion of FIG. 11 indicated by dashed lines pointed to by reference numeral 11A.
Figure 11B:
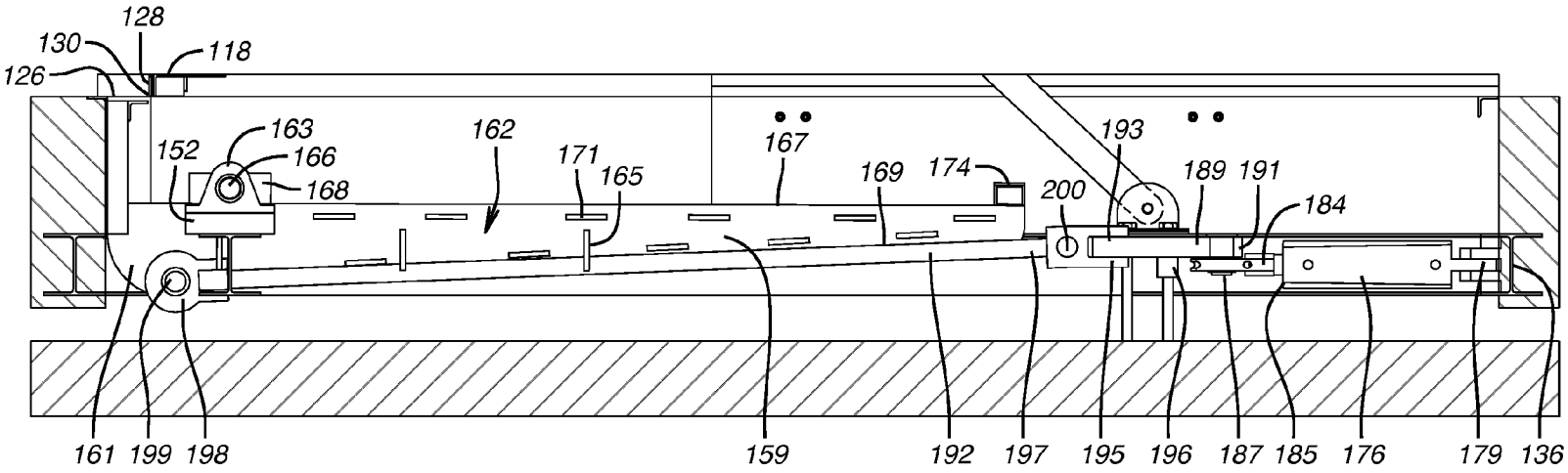

Referring to FIGS. 2, 3, 6 and 7 along with FIG. 1, an exemplary embodiment includes an upwardly open housing or pan 32 for panel 12 and pivotation members 26, 28. Housing or pan 32 includes a floor 34, front and back ends 36, 38, and lateral ends 40, 42, for containing panel 12 horizontally above floor 34 in the housing. Floor 34 includes a pair of slot openings 35, 37 transverse to first axis 30. As seen in FIGS. 1, 2, 6 and 7, a surface water portal into housing or pan 32 comprising aluminum grating 44 supported on floor 34 by vertical supports 45 gives water access to floor 34 when panel 12 is resident in housing 32. As best seen in FIGS. 1, 6 and 7, in an exemplary embodiment, a plurality of panel stiffing and support tubing members 46 are connected to the bottom 16 of panel 12 transverse to the first axis of rotation. The tubing members 46 have a height spacing panel bottom 16 from floor 34 of housing 32 when panel 12 is resident in housing 32. This spacing permits surface water entering through portal 44 to rise beneath panel 12 and buoy panel 12 pivotingly upwardly from housing 32 for rotation upwardly about axis 30. Also, as seen in FIGS. 2 and 7, a plurality of housing or pan support tubing members 48 are connected to the floor 34 of housing 32 transverse to the first axis of rotation 30 and spaced from where panel support tubing members 46 will contact floor 34. Pan support tubing members 48 provide additional support to panel 12 when it is resident in housing 32. Further referring to FIGS. 1, 2 and 7, a plurality of foldable retention arms 21 are hingedly mounted on pan 32 at anchor plates 23 and on panel 12 at anchor plates 25. FIGS. 1, 2 and 3 show wiper walls 47, 49 flanking housing 32 and panel 12.

Referring to FIGS. 1, 2, 3, 6 and 7, housing 32 is supported by vertical flange installation members 50 connected to the bottom of floor 34 that stand on horizontal flange installation members 52. Flange installation members 50 and 52 are lodged captured in a poured concrete foundation in an installation of barrier 10. In an exemplary embodiment, also lodged captured in a poured concrete foundation in an installation of barrier 10 are a pair of longitudinally spaced upwardly open parallel channel members 54, 56 that run from back 51 to front 53 transversely to the first axis of rotation 30 and are upwardly edge connected to margins of slot openings 35, 37 in housing floor 34. Referring particularly to FIGS. 1, 2 and 7, a longitudinal trough 58 in floor 34 of housing 32 is transected by the slot openings 35, 37 and upper openings 55, 57 of respective channel members 54, 56 at intersections of trough 58 and the slot openings 35, 37 and upper openings 55, 57 of respective channel members 54, 56. Trough 58 has a drain opening 60 in the trough between the channel member intersections for draining water from pan 32 when water entering pan 32 through portal 44 has risen above the level of the upward openings 55, 57 of channel members 54, 56.

Referring particularly to FIGS. 1, 2 and 4-7, in an exemplary embodiment, a pair of lift arms 62, 64 are pivotably mounted under slot openings 35, 37 of floor 34 inside upwardly open channel members 54, 56, respectively. The lift arms 62, 64 are pivotable about an axle or rod 66 mounted in blocks 63, 65 connected to and supported by floor 34 and carried on arms 62, 64 by carriers 68, 68'. Axle 66 provides a horizontal second axis of rotation parallel to, lower than and forward of the first axis of rotation 30. In an exemplary embodiment, the arms 62, 64 each have fore and aft portions 59, 61 and top and bottom surfaces 67, 69. The fore portion of arms 62, 64 is forward of axle 66. The aft portion of arms 62, 64 is rearward of axles 66.

Figure 5:
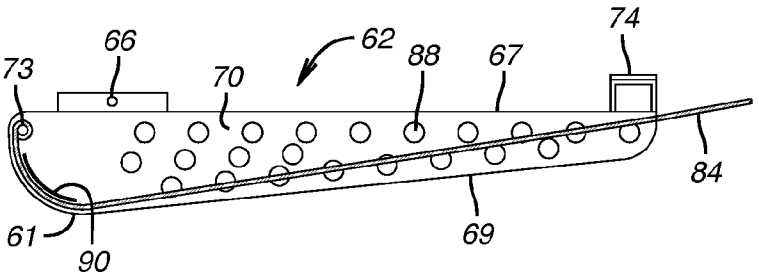
Figure 4:
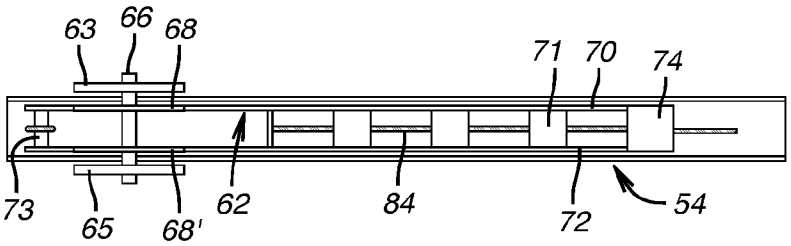

In an exemplary embodiment, arms 62, 64 each comprise horizontally spaced parallel vertical plates 70, 72 horizontally joined by horizontal joinder plates 71 and a horizontal pin 73. Pin 73 joins vertical plates 70, 71 at an upper part of aft portion 61 of vertical plates 70, 72 proximal top 67, i.e., rearward of and lower than the second axis of rotation of axle 66. As illustrated, the arms 62, 64 are vertically deepest at said aft portion 61. In an exemplary embodiment, lift arms 62, 64 vertically taper bottom toward top narrowing from aft portion 61 to fore portion 59. This lessens the weight of the arms past the pivotation fulcrum of axle 66 and lessens the force needed to pivot lift arms 62, 64 upwardly past the pivotation fulcrum 66. In an exemplary embodiment, as shown in FIGS. 5-7, the fore portions 59 of arms 62, 64 past the pivotation fulcrum of axle 66 are fenestrated as at 88 to lessen the weight of the arms past the pivotation fulcrum of axle 66 and lessen the force needed to pivot the fore portion 59 of lift arms 62, 64 upwardly. The lift arms may be both tapered as described and fenestrated as described. In an exemplary embodiment, the top or upper surface 67 of the lift arms 62, 64 includes, as shown, a projection 74 having an elevation at least as tall as the panel support tubing members 46.

Referring particularly to FIGS. 1-3, in an exemplary embodiment, a winch comprising a gear operator 76 is located in an enclosure 75 at the front 36 of housing 32 intermediate channel members 54, 56. Winch 76 has a drum 77 rotatable on a third axis of rotation 78 that is transverse to the first axis of rotation 30. A pair of roller guides 80, 82 mounted in gear operator enclosure 75 cooperate with a pair of pulleys 81, 83 comprising sheaves horizontally distally spaced from roller guides 80, 82 and drum 74 for a proper fleet angle are connected to housing 32 opposite and above the upwardly open front end of channel members 54, 56. In an exemplary embodiment, each of a pair of cables 84, 86 comprising wire ropes are connected on one end to drum 76 of winch 74 and at an opposite end are connected to pin 73 of lift arms 62, 64. Pin 73 is rearward of the location of aft portion 61 where lift arms 62, 64 are deepest and is proximate the top surface 67 of lift arms 62, 64. Cables 84, 86 run to an aft position proximate where the arm is vertically deepest and are guided by a cable guide 90 that is between where the arms are vertically deepest and where the cables re connected to pin 73. Cable guides 90 guide the cables upwardly from the aft position proximate where the arm is vertically deepest to where said cable is connected to pin 73. Cables 84, 86 route under lift arms 62, 64 to pulleys 80, 82 respectively, thence to drum 76. On activation of drum 76, cables 84, 86 pivotingly lever the arms 62, 64 rotationally upwardly out of housing 32 under panel 12 to rotationally raise panel 12 out of the housing. Drum 76 is activated by gear operator 76. Gear operator 76 is suitably operated with a portable drive motor.

Referring now to FIGS. 8-12, they show another exemplary embodiment of a flood guard barrier lift system in accordance with this invention in which a driver powered to effect lift comprises a hydraulic actuator driving a driven member acting on a lift arm.

Referring to FIGS. 8-11B, reference numeral 100 indicates an exemplary embodiment of a flood guard barrier 100. The flood guard barrier comprises a plurality of panel members, each 112, having a back end 118, a front end 120 and lateral ends 122, 124 and a longitudinal dimension between lateral ends 122, 124. A frame assembly includes front member 136, back member 138, a plurality of stringer members 150 connecting front and back members 136, 138, and cross members 152 between selected pairs of stringer members 152. Pivotation members comprise a stationary member 126 connected to back frame member 138 and a moveable member 128 moveably joined to stationary member 126, the moveable member being connected to back end 118 of panel 112 and pivotable about a horizontally longitudinal first axis of rotation 130 for pivotation of panel 112 rotationally upwardly about axis 130. See also FIGS. 1, 7-8 for the same arrangement in which the pivotation elements have the same reference numbers less 100, e.g., moveable member 128 corresponds to moveable member 28.

A plurality of lift arms 162 are positioned under panel 112 transversely to first axis of rotation 130. Each arm 162 is mounted by arm stands 168 on an axle 166 carried in bearing supports 163 fixed to a cross member 152 of frame assembly. Axle 166 provides pivotation of arms 162 about a horizontal second axis of rotation at 166 that is parallel to, lower than and forward of the first axis of rotation 130. Arms 162 have an aft portion 161 rearward of second axis 166 and a fore portion 159 forward of second axis 166.

In an exemplary embodiment, arms 162 comprise horizontally spaced parallel vertical plates 170, 172 horizontally joined by horizontal joinder plates 171 and vertical joinder plates 165 arced inferiorly to clear drive shaft 192. As illustrated, arms 162 are vertically deepest at said aft portion 161. In an exemplary embodiment, lift arms 162 vertically taper from bottom 169 toward top 167 narrowing from aft portion 161 to fore portion 159. This lessens the weight of the arms past the pivotation fulcrum of axle 166 and lessens the force needed to pivot lift arms 162 upwardly past the pivotation fulcrum 166. Although not shown in the depictions in FIGS. 8-12, the fore portions 159 of arms 162 may be fenestrated as depicted in FIGS. 5-7 for the same reason as explained in connection with those figures. In an exemplary embodiment, the top or upper surface 167 of the lift arms 162 includes, as shown, a projection 174 to more closely approximate the undersurface if panel 112 when panel 112 is horizontally reposed above arms 162. This projection 174 is the place of contact of arms 162 with panel 112 when arms 162 are rotated upwardly in second axis 166.

A plurality of hydraulic actuators 176 each is connected at its base 179 to front frame member 136. Each actuator 176 has a rod 184 connected to a piston moveable in a cylinder as explained above. Each such rod 184 is extendable transversely to first axis 130 from a head end 185 of each actuator 176 and is distally rotatably joined at a vertically journaled pin 187 to the proximal end 191 of an intermediate pivotation link 189. Pivotation link 189 pivots on vertical shaft 196. A plurality of drive shafts 192 each is pivotingly moveably joined proximally to a distal end 193 of an intermediate pivotation link 189 by a pin 194 vertically journaled in a U-joint connector 195 hinged to the proximate end 197 of shaft 192 by trunnion 200 laterally projecting from shaft 192. At the other (distal) end of shaft 192, shaft 192 is rotatably joined to an aft portion 161 of a lift arm 162, for example, at a hub 198 of shaft 192 riding on a trunnion 199 of lift arm 192, such that linear movement of a shaft 192 rotates an arm 162 on an axle 166.

Intermediate pivotation link 189 serves as a reversing drive linkage coupling actuator rod 184 to drive shaft 192 that connects to the aft portion 161 of lift arm 162. Extension of rod 184 drives the proximate end 191 of intermediate pivotation link 189 in the same direction, pivoting link 189 on shaft 196, which causes the distal end 193 of link 180 to move in the opposite direction, reversing the direction of force produced by actuator rod 184. Further extension of actuator rod 184 acts through the reversing link 189 to pull drive shaft 192 in a direction parallel and opposite the direction of extension movement of actuator rod 184. This rotates the aft portion 161 of the lift arm forward on axle 166 and rotates the fore portion 159 upward about the second axis of axle 166, lifting the flood barrier panel 112 rotationally upwardly about the first axis 130 to a raised flood guarding position.

In the exemplary embodiment of FIGS. 8-12, the location of the rotatable connection of each drive shaft 192 to an aft portion 161 of a lift arm 162, as by hub 198 of shaft 192 on a trunnion 199 at an aft portion 161 of a lift arm 162, is centered on the periphery of an imagined circle in which the center of the circle is the center of axle 166. The radial distance of this imaginary circle and the location of the rotatable hub-on-trunnion joint connecting shaft 192 to arm 162 on the imaginary circle is selected so that a drive shaft 192 need not travel more than twice such radial distance to effect rotation of a lift arm 162 through 90 degrees when on actuation of actuator 176 the aft portion 161 of lift arm 162 is rotated forward and the fore portion 159 of a lift 162 arm is rotated upward on second axis 166 to lift panel 112 rotationally upwardly on first axis 130 to a raised position. For example, in one embodiment of the type pictured in FIGS. 8-12, the centers of hub 198 of drive shaft 192 and the trunnion 199 of lift arm 162 are radially distanced or set off 6 inches from the center of axle 166 at a location at about 7 o'clock (about 210 degrees from zero degrees of rotation), and in this configuration drive shaft 192 need be moved only about 9.4 inches to rotate arm 162 upwardly through 90 degrees. This arrangement of linkage elements and drive shaft connection location at the aft portion of lift arm 162 permits the lift force for the panel 112 to be applied in a very flat package, which reduces the installation depth of the flood guard barrier, a construction advantage.

The above disclosed subject matter is to be considered illustrative, and not restrictive, and the appended claims are intended to cover all modifications, enhancements, and other embodiments that fall within the true scope of the present invention, which to the maximum extent allowed by law, is to be determined by the broadest permissible interpretation of the following claims and their equivalents, unrestricted or limited by the foregoing detailed descriptions of exemplary embodiments of the invention.

The invention claimed is:

1. A flood guard barrier comprising:

at least one buoyant panel having front, back and lateral ends, and a longitudinal dimension between the lateral ends and substantially horizontally disposed relative to earth, pivotation members comprising a stationary member connected to a support and a moveable member moveably joined to said stationary member, said moveable member being connected to said back end of a said panel and pivotable about a horizontally longitudinal first axis of rotation, said panel being passively responsive to a rise of water higher than the substantially horizontally disposed panel to buoyantly rotationally pivot upwardly about said first axis to a raised position, a secondary mechanism for elevating a said substantially horizontally disposed panel comprising:

a subframe unattached to a said panel and non-interferingly positioned under a said panel, at least one lift arm unattached to a said panel, positioned under a said panel transversely to said first axis of rotation, and pivotingly supported on said subframe for rotation from a horizontal disposition upwardly about a horizontal second axis of rotation that is parallel to and lower than said first axis of rotation, said arm having an aft portion rearward of said second axis and a fore portion forward of said second axis, at least one powered driver fixed on a support, and at least one driven member unit comprising at least one driven member connected proximately to a said powered driver and distally to a said aft portion of a lift arm at a connecting distance rearward of said second axis, whereby on activation of a said driver said aft portion is rotated forward and said fore portion is rotated upward on said second axis to lift a said panel rotationally upwardly on said first axis to a raised position.

2. The flood guard barrier of claim 1 in which said second axis of rotation is forward of said first axis of rotation.

3. The flood guard barrier of claim 1 in which said powered driver comprises at least one winch having a drum rotatable on a third axis of rotation and said driven member comprises a cable proximally connected to and windable on said drum, said third axis being either parallel or transverse to said first axis of rotation.

4. The flood guard barrier of claim 3 in which said third axis on which said drum is rotatable is parallel to said first axis and distally forward of said second axis.

5. The flood guard barrier of claim 3 in which said third axis on which said drum is rotatable is parallel to and rearward of said second axis and further comprising at least one cable pulley on a support horizontally distally forward of said second axis of rotation for reversing the direction of travel of cable sheaved through the pulley back toward said second axis.

6. The flood guard barrier of claim 3 in which said third axis on which said drum is rotatable is transverse to said first axis of rotation and distally forward of said second axis, said barrier further comprising at least one cable pulley distally forward of said second axis and horizontally spaced from said drum.

7. The flood guard barrier of claim 6 comprising a pair of said lift arms, a single winch, a pair of said pulleys each distally spaced from said drum, and a pair of said cables, each sheaved across a said pulley and distally connected to an aft portion of said lift arm.

8. The flood guard barrier of claim 7 wherein said subframe comprises a topless housing having a floor, a back and a front, sized for receiving and housing said panel horizontally above said floor, said stationary pivotation member being connected to said back of such housing, and wherein said floor comprises a pair of longitudinally spaced slots transverse to said first axis of rotation, a pair of longitudinally spaced upwardly open channel members parallel to said slots and connected under said slots to said housing floor, and wherein said lift arms reside horizontally disposed in said channel members under said panel when not lifted.

9. The flood guard barrier of claim 8 in which in which a said lift arm has a top and bottom, said cable connecting to said aft portion distally runs to said aft portion at a height lower than said lift arm top, said lift arm is vertically deepest top to bottom at an aft location, said lift arm tapers bottom toward top from said aft portion to said fore portion, and said aft portion where said cable is connected to said lift arm is rearward of said location where said arm is vertically deepest and proximate the top of the lift arm.

10. The flood guard barrier of claim 9 in which, when said lift arm is horizontal, said cable runs to a position proximate where the arm is vertically deepest, and wherein the arm includes a cable guide between where said arm is vertically deepest and where said cable is connected to said lift arm, for guiding said cable upwardly from said position proximate where the arm is vertically deepest to where said cable is connected to said lift arm.

11. The flood guard barrier of claim 9 in which said lift arm is fenestrated.

12. The flood guard barrier of claim 9 in which a said lift arm comprises a pair of horizontally spaced vertical plates joined in a fore portion by at least one horizontal joining member and in an aft position proximate their tops by a horizontal pin lower than said second axis of rotation, said cable attaching to said pin.

13. A flood guard barrier comprising:

a buoyant panel having front, back and lateral ends, and a longitudinal dimension between the lateral ends and substantially horizontally disposed relative to earth, a topless housing having a floor, a back, a front, and lateral ends, sized for receiving said panel horizontally above said floor, said floor having pivotation members comprising a stationary member connected to said housing back and a moveable member moveably joined to said stationary member, said moveable member being connected to said back end of said panel and pivotable about a horizontally longitudinal first axis of rotation, said panel being passively responsive to a rise of water higher than the substantially horizontally disposed panel to buoyantly rotationally pivot upwardly about said first axis to a raised position, said floor of said housing having a pair of longitudinally spaced slots transverse to said first axis of rotation, a pair of longitudinally spaced upwardly open channel members parallel to said slots and connected under said slots to said housing floor, a pair of lift arms resident in said channel members under said slots, each arm supported on from said floor for pivotation about a horizontal second axis of rotation that is parallel to, lower than and forward of said first axis of rotation, said arms having an aft portion rearward of said second axis and a fore portion forward of said second axis, a winch at the front of the housing intermediate said lateral ends of the housing and comprising a drum rotatable on a third axis of rotation transverse to said first axis of rotation, a pair of cable pulleys each connected adjacent the front of the housing horizontally distally spaced from said drum, and a pair of cables each connected on one end to said drum, each sheaved across a said pulley, and each connected at an opposite end to a said aft portion of a lift arm, each said cable on activation of said drum drawing said aft portion of a said connected lift arm rotationally downward and pivoting said fore portion of the lift arm rotationally upwardly out of a said channel member and through a said slot, raising said panel rotationally on said first axis upwardly out of said housing.

14. The flood guard barrier of claim 1 in which said powered driver comprises a hydraulic actuator.

15. The flood guard barrier of claim 14 in which a said driven member unit comprises a rod connected to a piston moveable in a cylinder in said hydraulic actuator, said driven member unit being connected to said aft portion of said lift arm.

16. The flood guard barrier of claim 15 in which said actuator is rearward of said second axis.

17. The flood guard barrier of claim 15 in which said actuator is distally forward of said second axis.

18. The flood guard barrier of claim 17 in which a said driven member unit comprises a drive shaft moveably joined distally to said aft portion of said lift arm and a drive linkage reversibly coupling said rod to said drive shaft.

19. The flood guard of claim 17 in which said connecting distance rearward of said second axis where said drive shaft is connected is a radial distance from said second axis sufficient that on actuation of said hydraulic actuator said drive shaft at said position of connection need not travel more than twice said radial distance to effect rotation of said lift arm through 90 degrees.

20. A flood guard barrier comprising:

a buoyant panel having front, back and lateral ends, and a longitudinal dimension between the lateral ends and substantially horizontally disposed relative to earth, subframe unattached to said panel and non-interferingly positioned under said panel and including front and back members, pivotation members comprising a stationary member connected to said back frame member and a moveable member moveably joined to said stationary member, said moveable member being connected to said back end of said panel and pivotable about a horizontally longitudinal first axis of rotation, said panel being passively responsive to a rise of water higher than the substantially horizontally disposed panel to buoyantly rotationally pivot upwardly about said first axis to a raised position, a secondary mechanism for elevating said horizontally disposed panel comprising:

a plurality of lift arms positioned under said panel transversely to the first axis of rotation, each arm mounted on an axle supported on said subframe for pivotation of said arms about a horizontal second axis of rotation that is parallel to, lower than and forward of said first axis of rotation, said arms having an aft portion rearward of said second axis and a fore portion forward of said second axis, a hydraulic actuator connected to a front member of said frame assembly, said actuator having a rod proximately connected to a piston moveable in a cylinder, a distal end of said rod extendable from a head end of the actuator in a direction transverse to said first axis, a reversing link proximately pivotingly joined to said distal end of said actuator rod and pivotal for reversing movement on a pivot shaft, a drive shaft proximally pivotingly joined to a distal end of said intermediate link and rotatably connected distally to said aft portion of a said lift arm at a radial distance measured from and rearward of said second axis selected such that on actuation of said actuator said drive shaft linked by said reversing link to said actuator rod need not travel a distance more than twice said radial distance to effect rotation of said lift arm on said second axis through 90 degrees to lift said panel rotationally upwardly on said first axis to a raised position.

21. The flood guard barrier of claim 20 wherein said subframe comprises a topless housing having a floor, a back and a front, sized for receiving and housing said panel horizontally above said floor, said stationary pivotation member being connected to said back of such housing, and wherein said floor comprises a pair of longitudinally spaced slots transverse to said first axis of rotation, a pair of longitudinally spaced upwardly open channel members parallel to said slots and connected under said slots to said housing floor, and wherein said lift arms reside horizontally disposed in said channel members under said panel when not lifted.

22. The flood guard barrier of claim 21 in which each lift arm is supported from said floor for pivotation about said second axis, each lift arm has a top and bottom, is vertically deepest top to bottom at an aft location, and tapers bottom toward top from said aft portion to said fore portion.

* * * * *